United States Patent [19]

Brickner et al.

[11] 4,141,724

[45] Feb. 27, 1979

[54] LOW-COST, HIGH TEMPERATURE OXIDATION-RESISTANT STEEL

[75] Inventors: Kenneth G. Brickner, O'Hara Township, Allegheny County; John L. Giove, Churchill Borough, Allegheny County, both of Pa.

[73] Assignee: United States Steel Corporation, Pittsburgh, Pa.

[21] Appl. No.: 917,624

[22] Filed: Jun. 21, 1978

[51] Int. Cl.[2] ..... C22C 38/28; C22C 38/34

[52] U.S. Cl. ..... 75/126 D; 75/124; 75/126 Q; 148/36

[58] Field of Search ..... 75/124, 126 D, 126 Q; 148/36

[56] References Cited

U.S. PATENT DOCUMENTS

| | | | |
|---|---|---|---|
| 3,698,964 | 10/1972 | Caule et al. | 148/36 |
| 3,893,849 | 7/1975 | Brickner | 75/126 C |
| 3,909,250 | 9/1975 | Jasper | 75/126 D |

*Primary Examiner*—Arthur J. Steiner

*Attorney, Agent, or Firm*—Forest C. Sexton

[57] ABSTRACT

A low-cost, weldable, high-temperature oxidation-resistant steel containing 0.04% maximum carbon, 2.60 to 4.0% chromium, 1.4 to 2.0% silicon, 0.1% maximum aluminum and sufficient titanium to stabilize the carbon and nitrogen.

4 Claims, No Drawings

LOW-COST, HIGH TEMPERATURE OXIDATION-RESISTANT STEEL

BACKGROUND OF THE INVENTION

In an effort to reduce polluting automobile emissions, a large segment of the automobile industry has been using emission control devices, such as catalytic converters on automobile exhaust systems. Such converters, through which the engine exhaust gases pass, are muffler-like devices which contain platinum-plated ceramic pellets or a monolith honeycomb material, which remove the hydrocarbons and carbon monoxide from the exhaust gases. Because of the rather high cost of the converter, it has been deemed necessary to fabricate the converter parts from an oxidation-resistant material so as to enhance its life span, in contrast to the rather short life of a conventional muffler. Because the exhaust gases are very hot, the fabricating material must also be a high temperature material, and for ease of construction should be weldable. The requirements for a weldable oxidation-resistant, high-temperature material has left designers with but one good choice, i.e. stainless steel.

Although stainless steel has been a most ideal material for use in fabricating catalytic converters, it is of course very expensive. To minimize cost, automobile manufacturers have been using the lowest cost stainless steel suitable for the purpose, i.e. AISI Type 409 stainless steel which contains about 11% chromium and 0.4% titanium. Emission control devices fabricated from Type 409 stainless steel have had extremely good service performance. The few failures that have occurred have been attributed to strength failures at elevated temperatures.

Because the extremely good service performance of present emission-control devices is an indication of overdesign, and because Type 409 stainless steel with its 11% chromium content is still very expensive, and because the supply of chromium is potentially unstable, automobile manufacturers would like to replace the Type 409 stainless steel with a lower cost steel having lower chromium contents, and hopefully having somewhat better high-temperature strength. Such a steel must however, have good formability and weldability comparable to Type 409 stainless steel. Although there are a number of stainless steel grades which contain appreciably lesser amounts of chromium than 11%, such grades have been unsuitable for use in emission control devices for one or more various reasons. For example, some high aluminum steels have been shown to have excellent oxidation-resistance at temperatures from 1400° to 2200° F. These steels, however, have rather erratic and hence unacceptable oxidation characteristics at temperatures of 1100° to 1400° F. More recently developed 3 to 6% chromium-aluminum steels have good oxidation-resistance at all temperatures up to 2200° F. To impart any useful degree of ductility into these steels, however, the steels must be rigidly deoxidized and degassed or made by vacuum-melting techniques which very greatly increases the cost of the steel. Still other low-chromium-aluminum grades of steel, although suitably priced, are not readily weldable.

SUMMARY OF THE INVENTION

The present invention provides a new and unique low-chromium steel which contains only 2.6 to 4% chromium and yet meets all the requirements for use in emission control devices. The new steel of this invention is characterized by high-temperature oxidation resistance at temperatures exceeding 1500° F. and good formability and weldability all of which are comparable to Type 409 stainless steel, and high temperature strength characteristics superior to Type 409. In addition the steel can be produced and processed pursuant to conventional low-cost techniques.

It is therefore an object of this invention to provide a new low-cost steel suitable for use in emission control devices.

Another object of this invention is to provide a new low-cost steel as an alternative choice to AISI Type 409 stainless steel but having superior high temperature strength characteristics.

A further object of this invention is to provide a new low-cost, high-temperature, oxidation-resistant steel having good formability and weldability characteristics.

These and other objects and advantages will become apparent from the following description.

DESCRIPTION OF THE PREFERRED EMBODIMENT

The prior art chromium-aluminum, high temperature steels mentioned above, typically contain 7–8% chromium and 6.5–8% aluminum. The balance is of course iron and incidental impurities. Because of the high alloy content, these steels cannot be cold rolled without excessive edge-cracking when the steel is produced in accordance with conventional steelmaking practices. In order to have any useful degree of ductility, these alloys must have exceptional low oxygen and gas contents, i.e. such low gas levels as can only be achieved by vacuum melting practices or by specialized chemical degassing practices.

More recently, U.S. Pat. No. 3,893,849, Brickner, discloses an improved chromium-aluminum alloy having somewhat more limited amounts of chromium and aluminum, i.e. 6.25% max. chromium and 5% to 7.0% max. aluminum, which exhibits useful ductility values without special deoxidation or degassing requirements. The weldability of this steel, however, is substantially poorer than that of AISI Type 409 stainless steel.

The steel alloy of this invention is somewhat similar to the above-discussed chromium-aluminum alloys but is based upon the finding that even lower amounts of chromium in combination with controlled amounts of silicon in contrast with significantly larger amounts of aluminum, will render a steel having comparable high-temperature oxidation resistance, good ductility and weldability and a high-temperature strength superior to AISI Type 409 stainless steel. In its broadest and preferred aspect, the composition limits of this steel are as follows:

| | Broad Range | Preferred Range |
|---|---|---|
| Carbon | 0.04% max. | 0.03% max. |
| Manganese | 1.00% max. | 0.30 to 0.60% |
| Silicon | 1.4 to 2.0% | 1.4 to 1.75% |
| Phosphorus | 0.045% max. | 0.03% max. |
| Sulfur | 0.035% max. | 0.025% max. |
| Chromium | 2.6 to 4.0% | 2.75 to 3.25% |
| Titanium | $6 \times (C + N)$min.–0.75% max. | 0.18 to 0.5% |
| Molybdenum | 0.60% max. | nil |
| Aluminum | 0.1% max. | 0.05% max. |

While it is generally known that chromium, aluminum and silicon will all impart some degree of corrosion and/or oxidation resistance to steels, it is of course recognized that chromium is far superior to aluminum and silicon, neither of which are particularly effective in small amounts. In view of this knowledge, one might reasonably expect that silicon could be substituted for aluminum in the above-discussed chromium-aluminum steels. Indeed, U.S. Pat. No. 3,698,964, Caule et al, discloses a low-chromium steel, i.e. 1 to 5% chromium, containing 1 to 4% aluminum and/or silicon. While this does teach that in such alloys silicon is the equivalent of aluminum, the crux of this invention resides in our discovery that in fact, silicon is far superior to aluminum, and in fact even modest amounts of aluminum are detrimental when using silicon. Specifically, this invention is based upon the discovery that when silicon and chromium are combined, somewhat lesser amounts of silicon will provide a comparable alloy insofar as oxidation properties are concerned, and a superior alloy insofar as high temperature strength, ductility and weldability are concerned. It is necessary, however, that the steel be titanium stabilized and that certain residual impurities such as carbon, and surprisingly aluminum, must be kept below minimum levels.

In its broadest aspect, the only essential additives to the steel of this invention are chromium, silicon and sufficient titanium to stabilize the small amounts of carbon and nitrogen present. While the broad chromium range is from 2.6 to 4.0%, the chromium content should ideally be about 3%. This small amount of chromium when combined broadly with from 1.4 to 2.0% silicon and preferably about 1.5% silicon, will, in absence of active carbon yield a steel having high temperature oxidation resistance up to temperatures in excess of 1500° F., comparable to AISI Type 409 stainless steel. As already suggested, carbon is especially detrimental to this steel in adversely affecting high-temperature oxidation resistance to a significant extent. It is necessary therefore that the carbon content be maintained at no more than 0.04% and then even such low carbon residuals be titanium stabilized such that the titanium content be at least six times the carbon plus nitrogen content, but not more than 0.75% titanium. While carbon contents in excess of 0.04% could also be stabilized with titanium, this would require more titanium than desired in the steel which would adversely affect the formability and toughness of the steel. Nitrogen contents on the other hand need not raise concern, as the typical residual nitrogen levels of 0.01% or less can readily be stabilized with titanium.

The usual residuals, phosphorus and sulfur, should be maintained below typical maximum limits of 0.045% and 0.035% each respectively, and preferably below 0.030% and 0.025% each respectively. Such maximum limits are not unusual for steels of this type and can readily be achieved. On the other hand, the 0.04% maximum carbon content is somewhat more restrictive than is typical for steels of this kind. Such low levels can nevertheless be easily achieved without undue expense by the newer oxygen-injection steel-producing methods such as AOD and Q-BOP.

The principal function of manganese in steels of this type is to combine with the sulfur and prevent the steel from being hot short during processing. A manganese content of about 10 times sulfur is sufficient to prevent hot shortness. Higher amounts of manganese, while not particularly detrimental, are costly.

As noted above, aluminum must be kept to low-residual levels, i.e. not more than 0.1 percent and preferably below 0.05 percent. Although aluminum might be equivalent to silicon with respect to oxidation resistance in some comparable steels, it cannot be tolerated in this steel in combination with the chromium, silicon, and titanium ranges disclosed, because even moderate amounts of aluminum will seriously impair the steel's weldability. Aluminum is a very strong ferritizing element, and thus we have found that the weld metal resulting from the welding of chromium-silicon-aluminum-titanium steels will solidify as a brittle coarse-grained ferritic structure with grain-boundary precipitates of a titanium-rich intermetallic compound. In contrast, weld metal of aluminum-free steels of similar compositions will solidify as mixture of pools of ferrite and low-carbon martensite and bainite without the embrittling grain-boundary precipitates, and this duplex structure is tough and ductile. It should also be noted that if the specified chromium, silicon, and titanium ranges of the invented steel are appreciably exceeded, then brittle welds will also result on welding because of the formation of a brittle coarse-grained ferritic microstructure with grain-boundary precipitates.

While molybdenum is not an essential constituent in the steel of this invention, tests have shown that small amounts thereof up to 0.60% will enhance the steel's oxidation-resistance at temperatures of about 1800° F. Below 1500° F., particularly 1300° F. and below, molybdenum is neither beneficial nor detrimental.

Another advantageous feature of this invention is its low cost of production. Specifically, U.S. Pat. No. Re. 28,494 discloses and claims a unique process for producing chromium-containing steels which is particularly beneficial in producing such steels for emission control devices. Pursuant to that process, chromium-containing steel slabs are hot-rolled according to conventional practices and then cold-rolled and annealed without removing the mill-scale formed during hot rolling. The cold rolled and annealed steel is then descaled. Leaving the hot roll mill scale on the steel during cold rolling and the final continuous anneal causes a uniform oxide film to be on the sheet surface during the anneal which substantially increases emissivity which permits quicker heat absorption during the anneal. As a result, the sheet can be continuous annealed at a substantially greater line speed, typically 50% greater, to further reduce costs.

The low-chromium-silicon-titanium steel of this invention can be cold rolled and annealed according to the above-described patented process to take full advantage thereof. In addition however, we have learned that the steel of this invention yields an additional advantage in being annealable at higher temperatures which will allow still faster line speeds. Specifically, whereas Type 409 stainless steel must be continuous annealed at metal temperatures no greater than about 1700° F., to avoid excessive hardness and consequent loss of ductility, the steel of this invention can be annealed at metal temperatures as high as 1800° to 1850° F. without hardness increases and loss of ductility. To understand the reasons for this advantage, it should first be recognized that the annealing furnace temperature is always higher than the temperature to which the metal is heated, by as much as 200° F., depending on such factors as strip line speed, strip thickness and the like. As used herein, all annealing temperatures refer to metal temperatures. This behavior is the result of differences in the alpha-gamma phase transformation characteristics of the two steels. The composition of the subject inventive steel is balanced in such a manner as to preclude transformation from alpha to gamma until annealing temperatures of about 1800° to 1850° F. are reached, the exact temperature depending upon the specific composition and amount of cold reduction prior to annealing. In contrast, Type 409 stainless steel will, depending on the specific composition and amount of cold reduction, transform to the gamma phase at temperatures as low as 1650° F.

To aid in a fuller understanding of this invention, the following will illustrate a series of tests wherein fifteen low-chromium, low-silicon steels were prepared having variable compositions. Table I below provides the compositions of those fifteen steels, as well as the compositions of five other similar steels. Steels 2, 3, 5, 6 and 7 are those steels which fall within the scope of this invention. Steels 1 through 15 were produced and processed in a laboratory under conditions as close to identically as could be performed and subsequently tested identically to determine the 1000-hour cyclic oxidation resistance at both 1300° F. and 1500° F. Table II below presents the results of those tests. Subsequently those steels having exceptional high-temperature oxidation resistance, i.e. those falling within the scope of this invention, were tested for tensile properties along with the Type 409 stainless. The results for the tests are shown in Tables III and IV.

TABLE II

Results of 1000-Hour Cyclic Oxidation Tests at 1300 and 1500° F for Steels Investigated

| Steel | Weight Gain, $Mg/Cm^2m$ at 1300° F | Weight Gain, $Mg/Cm^2m$ at 1500° F |
|---|---|---|
| 1 | 6.55 to 7.28 | 15.6 to 16.1 |
| 2+ | 0.26 to 0.40 | 0.70 to 0.80 |
| 3+ | 0.23 to 0.48 | 0.80 to 0.83 |
| 4 | 4.04 to 4.07 | 3.75 to 4.67 |
| 5+ | 0.29 to 0.38 | 0.37 to 0.65 |
| 6+ | 0.26 to 0.28 | 0.59 to 0.63 |
| 7+ | 0.73 to 0.76 | 1.01 to 1.09 |
| 8 | 5.37 to 5.80 | Oxide Spalled |
| 9 | 17.03 to 17.98 | 0.59 to 0.81++ |
| 10 | 15.67 to 22.86 | 28.07 to Spalled |
| 11 | 31.56 to 33.32 | 24.35 to Spalled |
| 12 | 14.05 to 24.73 | 23.78 to 31.30 |
| 13 | 21.09 to 21.87 | 11.53 to 12.94 |
| 14 | 16.24 to 20.52 | 11.52 to 17.36 |
| 15 | 0.73 to 1.06 | 0.48 to 0.63 |
| 16* | NT | 33.0** |
| 17* | NT | 89.0** |
| 18* | NT | 10.5** |
| 19 | 0.30 to 0.54 | 0.94 to 0.98 |
| 20 | NT | NT |

NT - Not tested.
*Data from literature; non-cyclic tests.
**1400° F. tests.
+Steels within the scope of my invention.
++Oxide may have spalled.

TABLE I

| Steel | Grade | Compositions of Steels Investigated--Percent C | Mn | P | S | Si | Cr | Al | Ti | Mo | N | Ti : C + N |
|---|---|---|---|---|---|---|---|---|---|---|---|---|
| 1 | 2Cr-1Si-1Al | 0.032 | 0.51 | 0.027 | 0.018 | 1.00 | 2.17 | 0.87 | NA | 0.06 | 0.009 | 0 : 1 |
| 2+ | 3Cr-1.5Si-Ti | 0.03 | 0.47 | 0.025 | 0.017 | 1.56 | 3.02 | 0.01 | 0.40 | 0.06 | 0.008 | 10.5 : 1 |
| 3+ | 3Cr-1.5Si-Mo-Ti | 0.028 | 0.48 | 0.027 | 0.017 | 1.56 | 2.98 | 0.01 | 0.40 | 0.23 | 0.008 | 11.1 : 1 |
| 4 | 2Cr-1Si-1Al | 0.016 | 0.50 | 0.012 | 0.013 | 1.01 | 2.20 | 0.86 | NA | 0.04 | 0.011 | 0 : 1 |
| 5+ | 3Cr-1.5Si-Ti | 0.016 | 0.48 | 0.010 | 0.013 | 1.55 | 3.08 | 0.004 | 0.18 | 0.03 | 0.012 | 6.4 : 1 |
| 6+ | 3Cr-1.5Si-Mo-Ti | 0.016 | 0.47 | 0.011 | 0.013 | 1.56 | 3.08 | 0.005 | 0.18 | 0.26 | 0.013 | 9.0 : 1 |
| 7+ | 3Cr-1.5Si-Ti | 0.037 | 0.48 | 0.026 | 0.015 | 1.62 | 3.00 | NA | 0.43 | 0.06 | 0.008 | 9.6 : 1 |
| 8 | 3Cr-1.5Si-Ti | 0.059 | 0.47 | 0.026 | 0.015 | 1.63 | 3.03 | NA | 0.42 | 0.06 | 0.008 | 6.3 : 1 |
| 9 | 3Cr-1.5Si-Ti | 0.084 | 0.47 | 0.026 | 0.015 | 1.62 | 3.00 | NA | 0.41 | 0.06 | 0.009 | 4.4 : 1 |
| 10 | 3Cr-1.5Si | 0.018 | 0.48 | 0.026 | 0.016 | 1.55 | 2.95 | NA | NA | 0.05 | 0.009 | 0 : 1 |
| 11 | 3Cr-1.5Si | 0.041 | 0.48 | 0.026 | 0.016 | 1.53 | 2.95 | NA | NA | 0.06 | 0.009 | 0 : 1 |
| 12 | 3Cr-1.5Si | 0.06 | 0.48 | 0.026 | 0.016 | 1.42 | 2.92 | NA | NA | 0.06 | 0.010 | 0 : 1 |
| 13 | 2Cr-1.2Si-0.4Al-Ti | 0.061 | 0.48 | 0.023 | 0.018 | 1.28 | 2.08 | 0.38 | 0.42 | 0.06 | 0.006 | 6.3 : 1 |
| 14 | 2Cr-1.2Si-0.7Al-Ti | 0.062 | 0.48 | 0.023 | 0.017 | 1.27 | 2.07 | 0.74 | 0.42 | 0.06 | 0.007 | 6.1 : 1 |
| 15 | 2Cr-1.2Si-1.4Al-Ti | 0.06 | 0.47 | 0.023 | 0.016 | 1.23 | 2.06 | 1.40 | 0.41 | 0.06 | 0.006 | 6.2 : 1 |
| 16* | 5Cr-1Si-Mo-Ti | 0.06 | 0.40 | NR | NR | 1.04 | 4.86 | NR | 0.40 | 0.54 | 0.010 | 5.7 : 1 |
| 17* | 5Cr-0.4Si-Mo-Ti | 0.06 | 0.36 | NR | NR | 0.41 | 5.18 | NR | 0.46 | 0.58 | 0.010 | 6.6 : 1 |
| 18* | 3Cr-1.5Si-Mo | 0.11 | 0.55 | NR | NR | 1.59 | 3.19 | NR | NR | 0.55 | 0.010 | 0 |
| 19 | 11Cr-Ti (Type 409) | 0.031 | 0.50 | 0.025 | 0.010 | 0.50 | 10.95 | 0.005 | 0.33 | 0.06 | 0.013 | 7.5 : 1 |
| 20 | 11Cr-Ti (Type 409) | 0.056 | 0.55 | 0.024 | 0.012 | 0.55 | 11.15 | 0.007 | 0.30 | 0.065 | 0.013 | 4.3 : 1 |

*Data from literature, nitrogen estimated. NA denotes none added and NR denotes not reported.
30 Steels within the scope of my invention.

TABLE I

| Steel | Grade | Compositions of Steels Investigated--Percent C | Mn | P | S | Si | Cr | Al | Ti | Mo | N | Ti : C + N |
|---|---|---|---|---|---|---|---|---|---|---|---|---|
| 1 | 2Cr-1Si-1Al | 0.032 | 0.51 | 0.027 | 0.018 | 1.00 | 2.17 | 0.87 | NA | 0.06 | 0.009 | 0 : 1 |
| 2+ | 3Cr-1.5Si-Ti | 0.03 | 0.47 | 0.025 | 0.017 | 1.56 | 3.02 | 0.01 | 0.40 | 0.06 | 0.008 | 10.5 : 1 |
| 3+ | 3Cr-1.5Si-Mo-Ti | 0.028 | 0.48 | 0.027 | 0.017 | 1.56 | 2.98 | 0.01 | 0.40 | 0.23 | 0.008 | 11.1 : 1 |
| 4 | 2Cr-1Si-1Al | 0.016 | 0.50 | 0.012 | 0.013 | 1.01 | 2.20 | 0.86 | NA | 0.04 | 0.011 | 0 : 1 |
| 5+ | 3Cr-1.5Si-Ti | 0.016 | 0.48 | 0.010 | 0.013 | 1.55 | 3.08 | 0.004 | 0.18 | 0.03 | 0.012 | 6.4 : 1 |
| 6+ | 3Cr-1.5Si-Mo-Ti | 0.016 | 0.47 | 0.011 | 0.013 | 1.56 | 3.08 | 0.005 | 0.18 | 0.26 | 0.013 | 9.0 : 1 |
| 7+ | 3Cr-1.5Si-Ti | 0.037 | 0.48 | 0.026 | 0.015 | 1.62 | 3.00 | NA | 0.43 | 0.06 | 0.008 | 9.6 : 1 |
| 8 | 3Cr-1.5Si-Ti | 0.059 | 0.47 | 0.026 | 0.015 | 1.63 | 3.03 | NA | 0.42 | 0.06 | 0.008 | 6.3 : 1 |
| 9 | 3Cr-1.5Si-Ti | 0.084 | 0.47 | 0.026 | 0.015 | 1.62 | 3.00 | NA | 0.41 | 0.06 | 0.009 | 4.4 : 1 |
| 10 | 3Cr-1.5Si | 0.018 | 0.48 | 0.026 | 0.016 | 1.55 | 2.95 | NA | NA | 0.05 | 0.009 | 0 : 1 |
| 11 | 3Cr-1.5Si | 0.041 | 0.48 | 0.026 | 0.016 | 1.53 | 2.95 | NA | NA | 0.06 | 0.009 | 0 : 1 |
| 12 | 3Cr-1.5Si | 0.06 | 0.48 | 0.026 | 0.016 | 1.42 | 2.92 | NA | NA | 0.06 | 0.010 | 0 : 1 |
| 13 | 2Cr-1.2Si-0.4Al-Ti | 0.061 | 0.48 | 0.023 | 0.018 | 1.28 | 2.08 | 0.38 | 0.42 | 0.06 | 0.006 | 6.3 : 1 |
| 14 | 2Cr-1.2Si-0.7Al-Ti | 0.062 | 0.48 | 0.023 | 0.017 | 1.27 | 2.07 | 0.74 | 0.42 | 0.06 | 0.007 | 6.1 : 1 |
| 15 | 2Cr-1.2Si-1.4Al-Ti | 0.06 | 0.47 | 0.023 | 0.016 | 1.23 | 2.06 | 1.40 | 0.41 | 0.06 | 0.006 | 6.2 : 1 |
| 16* | 5Cr-1Si-Mo-Ti | 0.06 | 0.40 | NR | NR | 1.04 | 4.86 | NR | 0.40 | 0.54 | 0.010 | 5.7 : 1 |
| 17* | 5Cr-0.4Si-Mo-Ti | 0.06 | 0.36 | NR | NR | 0.41 | 5.18 | NR | 0.46 | 0.58 | 0.010 | 6.6 : 1 |
| 18* | 3Cr-1.5Si-Mo | 0.11 | 0.55 | NR | NR | 1.59 | 3.19 | NR | NR | 0.55 | 0.010 | 0 |
| 19 | 11Cr-Ti (Type 409) | 0.031 | 0.50 | 0.025 | 0.010 | 0.50 | 10.95 | 0.005 | 0.33 | 0.06 | 0.013 | 7.5 : 1 |
| 20 | 11Cr-Ti (Type 409) | 0.056 | 0.55 | 0.024 | 0.012 | 0.55 | 11.15 | 0.007 | 0.30 | 0.065 | 0.013 | 4.3 : 1 |

*Data from literature, nitrogen estimated. NA denotes none added and NR denotes not reported.
30 Steels within the scope of my invention.

TABLE III

Comparison of the Transverse Tensile Properties and Formability Parameters of Invented Steels With Those of Type 409 Steel

| Steel | Lower Yield Strength, ksi | Tensile Strength, ksi | Elongation in 2 Inches, percent | Normal Anisotropy, $r_m$ | Planar Anisotropy, $\Delta r$ | Strain Hardening, $\bar{n}$ |
|---|---|---|---|---|---|---|
| 2* | 45.3 | 75.6 | 30.0 | 1.31 | 0.22 | 0.19 |
| 3* | 45.6 | 75.4 | 28.0 | 1.20 | 0.02 | 0.19 |
| 5* | 41.9 | 69.9 | 33.8 | 1.46 | 0.47 | 0.20 |
| 6* | 43.1 | 71.4 | 32.0 | 1.39 | 0.41 | 0.20 |
| 7* | 46.8 | 74.2 | 31.6 | 1.49 | 0.31 | 0.19 |
| 19 (Type 409) | 38.2** | 67.9 | 30.0 | 0.99 | 0.05 | 0.19 |

*Steels within scope of my invention.
**0.2% offset yield strength.

TABLE IV

Comparison of the Room- and Elevated-Temperature Tensile Properties of the Invented Steel With Type 409 Steel

| Test Temperature, °F | Yield Strength (0.2% Offset), ksi | Tensile Strength, ksi | Elongation in 2 Inches percent |
|---|---|---|---|
| | Steel 2 (3Cr-1.5Si-Ti) | | |
| 75 | 45.3 | 75.8 | 30.5 |
| 600 | 31.2 | 62.8 | 22.5 |
| 800 | 27.0 | 55.5 | 20.5 |
| 1000 | 23.3 | 43.7 | 27.5 |
| 1200 | 16.7 | 24.8 | 27.0 |
| 1400 | 7.5 | 10.1 | 37.5 |
| 1600 | 3.7 | 4.2 | 32.0 |
| | Steel 19 (Type 409) | | |
| 75 | 38.3 | 70.3 | 29.5 |
| 600 | 25.8 | 55.1 | 22.5 |
| 800 | 24.5 | 48.7 | 19.5 |
| 1000 | 19.6 | 34.9 | 18.5 |
| 1200 | 12.5 | 18.8 | 21.0 |
| 1400 | 5.6 | 6.5 | 22.5 |
| 1600 | 3.2 | 4.2 | 37.5 |

Note:
Cold-rolled sheet steel, 0.050 inch thick, in the annealed (1650° F for 1 minute) condition was tested.

From the above tables the superior high-temperature oxidation-resistance of the inventive steel is readily apparent as indeed some steels were even slightly better than Type 409 stainless steel. The critical nature of the low carbon and need for titanium is also apparent.

Because of the importance of weldability to the manufacture of emission control devices, electric-resistance spot welding and electron-beam and gas-tungsten-arc welding tests were conducted on selected steel samples. The results showed that for the steels of this invention, i.e. 2, 3, 5, 6 and 7, full button pull out could be achieved in spot-weld peel tests, that 100% joint efficiency was obtained on all samples welded by electron-beam and gas-tungsten-arc methods, and that transverse samples from sheets welded by both methods could be successfully bent flat over a mandrel equal to one sheet thickness. In contrast, steels 13, 14 and 15, containing aluminum, failed when subjected to the same bend test.

Table III compares the tensile properties and formability properties of the inventive steel with those of Type 409 stainless steel. It can be noted that the inventive steel is slightly stronger, has about the same ductility and strain-hardening characteristics, and exhibits significantly better drawability, as measured by normal anisotropy.

Table IV compares the elevated-temperature tensile properties of the inventive steel with those of Type 409 stainless steel. For all temperatures up to 1600° F., the inventive steel is stronger than Type 409 stainless steel.

Of particularly commercial significance, as discussed above, is the fact that the steel of this invention can be processed pursuant to the method discussed and claimed in U.S. Pat. No. Re28,494, which is a cost saving process particularly desired by automobile manufacturers. Of major significance is the fact that the steel of this invention is amenable to annealing at higher temperatures than Type 409 stainless steel with a resulting additional cost savings because of the faster allowable annealing line speeds.

Table V below shows the effect on hardness of various metal annealing temperatures between 1400° and 1800° F. on the subject inventive steels in contrast with Type 409 stainless steel. Contrasted are steels 2, 3, 5 and 6 which are steels according to this invention, with steels 19 and 20, which are Type 409 stainless steels. The compositions are shown in Table I above. The table below shows that the hardness of all steels are markedly reduced when annealed at 1400° F., indicating that recrystallization has taken place. With an increase in annealing temperature, slightly further softening takes place, indicating that grain growth is occurring. Finally, an annealing temperature is reached where the hardness increases, indicating that transformation from alpha to gamma phase is occurring. It can be noted from the table that steels 2 and 3 showed no increase in hardness at annealing temperatures between 1400° and 1800° F., and that steels 5 and 6 showed no increase in hardness until annealed at 1800° F. In contrast, the Type 409 stainless steels showed an increase in hardness at temperatures as low as 1650° F.

TABLE V

Effect of Annealing Temperature on Hardness of Steels Investigated

| Steel | As-Cold-Reduced Hardness[1] | Annealing Temperature, °F 1400 Hd[2] | 1450 Hd | 1500 Hd | 1550 Hd | 1600 Hd | 1650 Hd | 1700 Hd | 1750 Hd | 1800 Hd |
|---|---|---|---|---|---|---|---|---|---|---|
| 1 | 22.4 | 82 | 83 | 84 | 84 | 85 | 85 | 86 | 85 | 91 |
| 2 | 24.1 | 84 | 80 | 80 | 70 | 82 | 77 | 77 | 76 | 75 |
| 3 | 25.0 | 88 | 82 | 81 | 80 | 81 | 78 | 77 | 76 | 77 |
| 4 | 20.5 | 79 | 79 | 79 | 78 | 77 | 74 | 76 | 76 | 75 |
| 5 | 22.6 | 77 | 76 | 75 | 76 | 77 | 74 | 75 | 75 | 99 |
| 6 | 22.4 | 77 | 76 | 77 | 76 | 76 | 73 | 76 | 76 | 93 |
| 19 | 27.4 | 88 | 86 | 85 | 83 | 84 | 92 | 99 | 102 | 105 |

TABLE V-continued

| Effect of Annealing Temperature on Hardness of Steels Investigated | | | | | | | | | | |
|---|---|---|---|---|---|---|---|---|---|---|
| | As-Cold-Reduced | Annealing Temperature, ° F | | | | | | | | |
| Steel | Hardness[1] | 1400 Hd[2] | 1450 Hd | 1500 Hd | 1550 Hd | 1600 Hd | 1650 Hd | 1700 Hd | 1750 Hd | 1800 Hd |
| 20 | 22.3 | 80 | 75 | 74 | 74 | 73 | 72 | 71 | 85 | 82 |

[1]Hardness, Rockwell C, after cold reduction from about 0.125 inch thick to 0.050 inch thick.
[2]Hardness, Rockwell B.
Note:
All samples were annealed for 1 minute in salt, and then water-quenched.

To further exemplify the advantageous annealing characteristics of this inventive steel, a commercial sized heat was produced subsequent to the above laboratory tests. The finished steel had the following chemistry: 0.028% C., 0.61% Mn, 0.014% P, 0.007% S, 1.40% Si, 0.05% Ni, 3.90% Cr, 0.31% Ti, 0.016% Mo, 0.019% Al and 0.005% N, as made on a 0.125-inch hot rolled band. A sample thereof was annealed at various temperatures from 1600° to 1950° F. as shown in Table VI below to determine the effect on tensile properties. Again it is shown that the steel of this invention can be annealed at higher temperatures than can Type 409 stainless steel, thus permitting faster line speeds and greater throughput to reduce production costs.

TABLE VI

| Effect of Annealing Temperature on the Tensile Properties of Sheet of Steel 21 | | | |
|---|---|---|---|
| Annealing Temperature, ° F* | Yield Strength (0.2% Offset), ksi | Tensile Strength, ksi | Elongation in 2 Inches, Percent |
| 1600 | 44.6 | 73.1 | 31 |
| 1650 | 43.9 | 72.1 | 31.5 |
| 1700 | 42.5 | 71.8 | 30.5 |
| 1750 | 41.3 | 71.3 | 31 |
| 1800 | 39.7 | 71.2 | 31.5 |
| 1850 | 40.0 | 71.6 | 30.5 |
| 1900 | 42.7 | 73.9 | 24.5 |
| 1950 | 48.0 | 77.6 | 21.5 |

*Annealed for 1 minute in salt and air cooled.
Note:
The steel was from a 100-ton production heat. The results are the average of two tests.

We claim:

1. A low-cost, weldable, high-temperature oxidation resistant steel consisting essentially of:

| | |
|---|---|
| carbon | 0.04% max. |
| manganese | 1.00% max. |
| phosphorous | 0.045% max. |
| sulfur | 0.035% max. |
| aluminum | 0.1% max. |
| chromium | 2.60 to 4.0% |
| silicon | 1.4 to 2.0% |
| titanium | 6 × (C+N)min. to 0.75% max. |
| molybdenum | 0.60% max. |
| iron | balance plus incidental impurities |

-continued

2. A steel according to claim 1 wherein the following constituents are further limited to:

| | |
|---|---|
| carbon | 0.03% max. |
| manganese | 0.30 to 0.60% |
| phosphorous | 0.03% max. |
| sulfur | 0.025% max. |
| aluminum | 0.05% max. |
| chromium | 2.75 to 3.25% |
| silicon | 1.4 to 1.75% |
| titanium | 0.18 to 0.5% |

3. A steel according to claim 1 or claim 2 which when welded exhibits, in the weld area, a mixture of ferrite, martensite and bainite.

4. An emission control device formed from a low-cost, high-temperature oxidation-resistant sheet steel consisting essentially of:

| | |
|---|---|
| carbon | 0.04% max. |
| manganese | 1.00% max. |
| phosphorous | 0.045% max. |
| sulfur | 0.035% max. |
| aluminum | 0.1% max. |
| chromium | 2.60 to 4.0% |
| silicon | 1.4 to 2.0% |
| titanium | 6 × (C+N)min. to 0.75% max. |
| molybdenum | 0.60% max. |
| iron | balance plus incidental impurities |

| | |
|---|---|
| carbon | 0.04% max. |
| manganese | 1.00% max. |
| phosphorous | 0.045% max. |
| sulfur | 0.035% max. |
| aluminum | 0.1% max. |
| chromium | 2.60 to 4.0% |
| silicon | 1.4 to 2.0% |
| titanium | 6 × (C+N)min. to 0.75% max. |
| molybdenum | 0.60% max. |
| iron | balance plus incidental impurities |

* * * * *